US008434845B2

(12) United States Patent
Jeong

(10) Patent No.: US 8,434,845 B2
(45) Date of Patent: May 7, 2013

(54) IMAGE FORMING APPARATUS AND INK JETTING METHOD THEREOF

(75) Inventor: Jin-wook Jeong, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 872 days.

(21) Appl. No.: 11/858,465

(22) Filed: Sep. 20, 2007

(65) Prior Publication Data

US 2008/0170095 A1 Jul. 17, 2008

(30) Foreign Application Priority Data

Jan. 17, 2007 (KR) ..... 10-2007-0005453

(51) Int. Cl.
*B41J 29/38* (2006.01)

(52) U.S. Cl.
USPC ..... 347/14; 348/169

(58) Field of Classification Search ..... 347/19, 347/14
See application file for complete search history.

(56) References Cited

U.S. PATENT DOCUMENTS

| | | | | |
|---|---|---|---|---|
| 5,518,323 | A * | 5/1996 | Sakaino et al. | 400/55 |
| 6,412,903 | B1 | 7/2002 | Lee et al. | |
| 6,471,315 | B1 * | 10/2002 | Kurata | 347/8 |
| 6,910,752 | B2 * | 6/2005 | Shoji | 347/14 |
| 7,083,274 | B2 | 8/2006 | Morita et al. | |
| 7,114,792 | B2 | 10/2006 | Kawauchi et al. | |
| 7,150,514 | B2 | 12/2006 | Horii et al. | |
| 7,712,857 | B2 | 5/2010 | Igarashi | |
| 2001/0030671 | A1 * | 10/2001 | Fujimori | 347/19 |
| 2001/0038397 | A1 * | 11/2001 | Kobayashi et al. | 347/14 |
| 2002/0041299 | A1 | 4/2002 | Lee et al. | |
| 2003/0020769 | A1 * | 1/2003 | Sarmast | 347/7 |
| 2004/0179055 | A1 | 9/2004 | Kawauchi et al. | |
| 2005/0041056 | A1 * | 2/2005 | Ide et al. | 347/24 |
| 2005/0063753 | A1 | 3/2005 | Morita et al. | |
| 2005/0078134 | A1 * | 4/2005 | Igarashi | 347/14 |

FOREIGN PATENT DOCUMENTS

| | | |
|---|---|---|
| EP | 1 375 146 | 1/2004 |
| EP | 1 657 063 | 5/2006 |
| JP | 54048552 | 4/1979 |
| JP | 5193136 | 8/1993 |
| JP | 2001-096733 | 4/2001 |
| JP | 2001146002 | 5/2001 |
| JP | 2002-052717 | 2/2002 |
| JP | 2002178505 | 6/2002 |
| JP | 2002-240280 | 8/2002 |
| JP | 2003266654 | 9/2003 |
| JP | 2003-341065 | 12/2003 |

(Continued)

OTHER PUBLICATIONS

Office Action issued Feb. 5, 2008, from Japanese Patent Office with respect to Japanese Patent Application No. 2004-376466, filed on Dec. 27, 2004.

(Continued)

*Primary Examiner* — Laura Martin
(74) *Attorney, Agent, or Firm* — Stanzione & Kim, LLP

(57) ABSTRACT

An image forming apparatus includes a plurality of head chips which comprise a plurality of nozzles to jet ink to a print medium according to print data, and a controller which compares jetting gaps of the head chips to the print medium with a reference jetting gap and determines jetting times of the head chips.

24 Claims, 4 Drawing Sheets

FOREIGN PATENT DOCUMENTS

| | | |
|---|---|---|
| JP | 2004268452 | 9/2004 |
| JP | 2005028715 | 2/2005 |
| JP | 2005-088523 | 4/2005 |
| JP | 2006-212874 | 8/2006 |
| JP | 2006227192 | 8/2006 |
| JP | 2006264074 | 10/2006 |
| KR | 2004-59309 | 7/2004 |
| KR | 2004-76584 | 9/2004 |
| KR | 2005-68008 | 7/2005 |

OTHER PUBLICATIONS

European Office Action Issued on EP Patent Application No. 08100500.1 on Jul. 30, 2012.

Japanese Notice of Final Rejection Issued on Aug. 7, 2012 in JP Patent Application No. 2007-222362.

Japanese Office Action mailed on Apr. 3, 2012 in JP Patent Application No. 2007-222362.

* cited by examiner

IMAGE FORMING APPARATUS AND INK JETTING METHOD THEREOF

CROSS-REFERENCE TO RELATED APPLICATIONS

This application claims priority from Korean Patent Application No. 10-2007-0005453, filed on Jan. 17, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus and an ink jetting method thereof, more particularly, to an image forming apparatus which determines a time of jetting an ink and an ink jetting method thereof.

2. Description of the Related Art

An image forming apparatus forms a print image on a print medium on the basis of print data. The image forming apparatus forms the print image by exposing a photosensitive member or jetting ink to the print medium.

The image forming apparatus includes a plurality of head chips and nozzles provided in the head chips to jet ink according to the print data, thereby forming the print image on the print medium.

However, the head chips in the image forming apparatus are different in a jetting speed according to variations in a manufacturing process and in a jetting gap with the print medium. Accordingly, a quality of the print image may be deteriorated.

To improve the foregoing disadvantage, in a conventional image forming apparatus, the summation of a resistance of a heater in the head chips and a resistance of a field effect transistor (FET) is used to compensate for a variation of a wire resistance only. However, there is a limitation in reducing variations of images printed on a print medium by controlling jetting times of the head chips according to the wire resistance.

SUMMARY OF THE INVENTION

The present general inventive concept provides an image forming apparatus and an ink jetting method thereof to adjust a jetting time of a head chip according to a jetting gap of the head chip with a print medium and a jetting speed of the head chip, thereby maintaining a quality of a print image regardless of a variation of the head chip in a manufacturing process.

Additional aspects and utilities of the present general inventive concept will be set forth in part in the description which follows and, in part, will be obvious from the description, or may be learned by practice of the present general inventive concept.

The foregoing and/or other aspects of the present general inventive concept can be achieved by providing an image forming apparatus comprising a plurality of head chips which comprise a plurality of nozzles to jet ink to a print medium according to print data, and a controller which compares jetting gaps of the head chips to the print medium with a reference jetting gap and determines jetting times of the head chips.

The controller may compare jetting speeds of the head chips with a reference jetting speed and may determine the jetting times of the head chips.

The image forming apparatus may further include a storage part, and the controller may store the jetting times according to the reference jetting gap in the storage part.

The foregoing and/or other aspects of the present general inventive concept can also be achieved by providing an image forming apparatus comprising a plurality of head chips which comprise a plurality of nozzles to jet ink to a print medium according to print data, and a controller which compares jetting speeds of the head chips with a reference jetting speed and determines jetting times of the head chips.

The image forming apparatus may further include a storage part, and the controller may store the jetting times according to the reference jetting speed in the storage part.

The controller may determine a jetting time of at least one of the head chips, and may determine a jetting time of the other head chips according to the jetting time of the at least one of the head chips.

The controller may compare jetting gaps of the nozzles to the print medium with a reference jetting gap and may determine the jetting times of the nozzles.

The controller may compare jetting speeds of the nozzles with a reference jetting speed and may determine the jetting times of the nozzles.

The foregoing and/or other aspects of the present general inventive concept can also be achieved by providing an ink jetting method of an image forming apparatus which comprises a plurality of head chips including a plurality of nozzles to jet ink to a print medium according to print data, the method comprising comparing jetting gaps of the head chips to the print medium with a reference jetting gap, and determining jetting times of the head chips according to the result of comparison.

The comparing may further include comparing jetting speeds of the head chips with the reference jetting speed.

The ink jetting method may further include storing the reference jetting gap and the reference jetting speed, and the comparing may include comparing the jetting gaps of the head chips and the jetting speeds thereof with the reference jetting gap and the reference jetting speed, respectively.

The foregoing and/or other aspects of the present general inventive concept can also be achieved by providing an ink jetting method of an image forming apparatus which comprises a plurality of head chips including a plurality of nozzles to jet ink to a print medium on the basis of a print data, the method comprising comparing jetting speeds of the head chips with a reference jetting speed, and determining jetting times of the head chips according to the result of comparison.

The ink jetting method may further include storing the reference jetting gap and the reference jetting speed, and the comparing may include comparing the jetting gaps of the head chips and the jetting speeds thereof with the reference jetting gap and the reference jetting speed, respectively.

A jetting time of at least one of the head chips is determined, and the determining the jetting times may include determining a jetting time of the other head chips.

The comparing may further include comparing jetting gaps of the nozzles to the print medium with the reference jetting gap, and the determining the jetting times may include determining jetting times of the nozzles.

The comparing may further include comparing jetting speeds of the nozzles with the reference jetting speed, and the determining the jetting times may include determining jetting times of the nozzles.

The foregoing and/or other aspects of the present general inventive concept can also be achieved by providing an image forming apparatus including a plurality of head chips each having a plurality of nozzles to jet ink to a print medium according to print data, and a controller to generates jetting times of the respective head chips according to one or more jetting gaps and one or more jetting speeds of the head chips.

The foregoing and/or other aspects of the present general inventive concept can also be achieved by providing a method of an image forming apparatus having a plurality of head chips each having a plurality of nozzles to jet ink to a print medium according to print data, the method including generating jetting times of the respective head chips according to one or more jetting gaps and one or more jetting speeds of the head chips.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
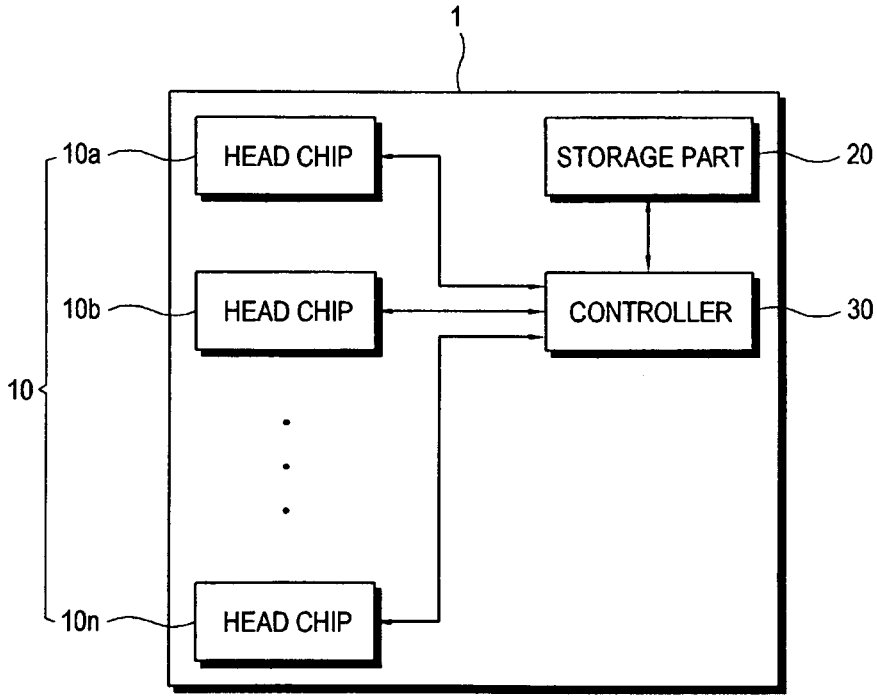
FIG. 1 is a block diagram to illustrate an image forming apparatus according to an exemplary embodiment of the present general inventive concept.

Reference will now be made in detail to the embodiments of the present general inventive concept, examples of which are illustrated in the accompanying drawings, wherein like reference numerals refer to like elements throughout. The embodiments are described below so as to explain the present general inventive concept by referring to the figures.

Figure 2:
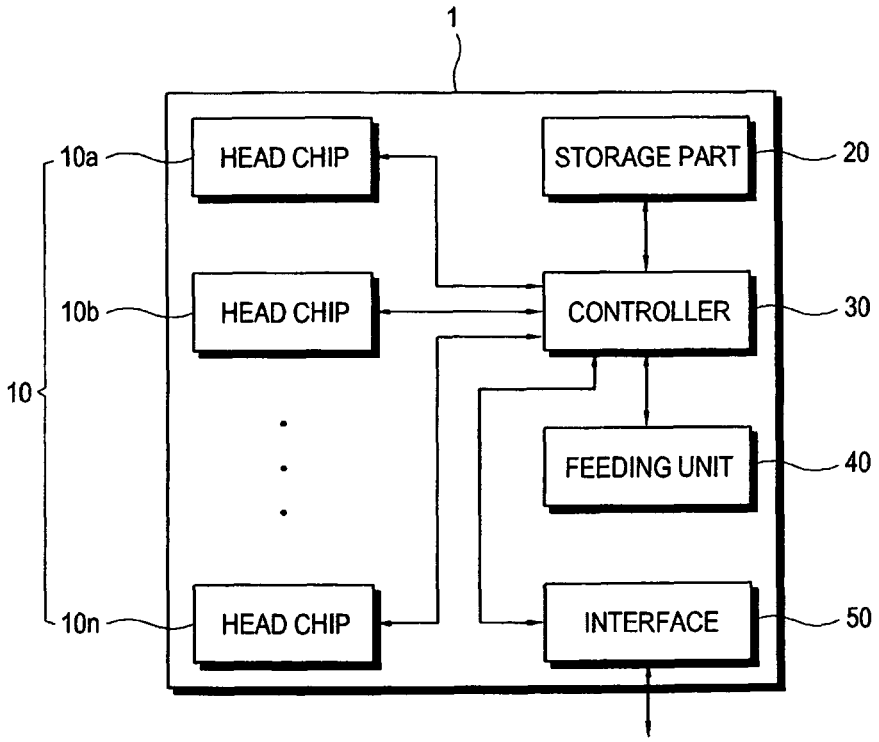
FIG. 2 is a block diagram to illustrate an image forming apparatus according to an another exemplary embodiment of the present general inventive concept.
Figure 3:
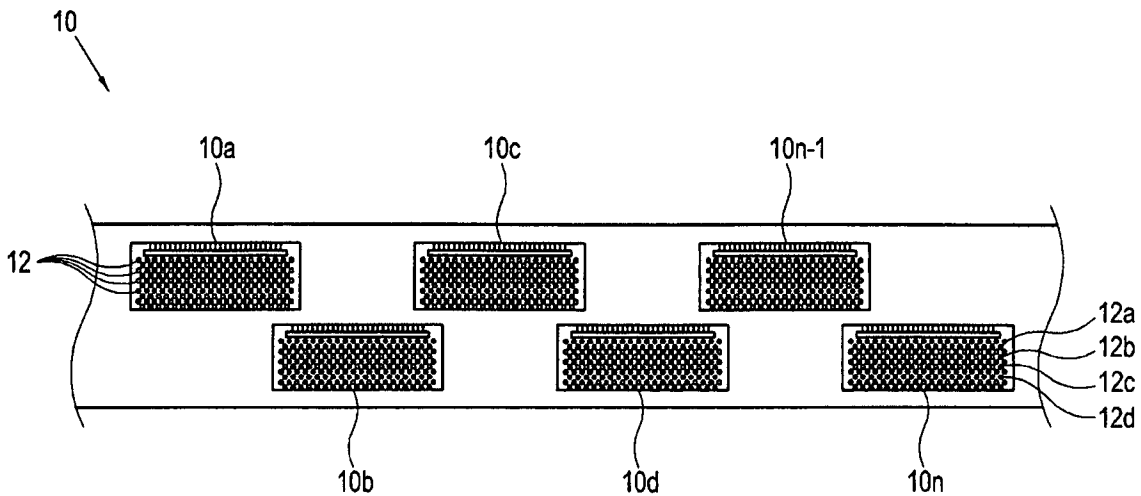
FIG. 3 is a block diagram to illustrate a configuration of a head chip of the image forming apparatus of FIG. 1 or 2.

Referring to FIGS. 1 and 2, an image forming apparatus 1 according to an exemplary embodiment of the present general inventive concept includes a printhead unit 10 having a plurality of head chips 10*a*, 10*b*, 10*c*, 10*d*, . . . 10*n*−1, and 10*n*, a storage part 20, and a controller 30. The image forming apparatus 1 may be provided as an array inkjet printer.

The image forming apparatus 1 may further include a medium feeding unit 40 to feed a print medium toward the printhead unit 10 in a feeding direction and to discharge the print medium to an outside thereof. The image forming apparatus 1 may further include an interface 50 to communicate with an external device to receive and transmit print data. The controller 30 controls the medium feeding unit 40 and the printhead unit 10 to form an image on the fed print medium according to the print data or internally generated print data.

The head chips 10*a*, 10*b*, . . . and 10*n* jet ink onto the print medium according to the print data. The head chips 10 according to the exemplary embodiment may be installed in a printing head of the printhead unit 10 disposed at one side of the image forming apparatus 1 and may be arranged in a line form. Further, the head chips 10 according to the present general inventive concept may be disposed to correspond to a width of the print medium or to have a longer length than the width of the print medium. The width of the print medium is referred to as a direction perpendicular to the feeding direction of the print medium.

Each of the head chips 10*a*, 10*b*, . . . , and 10*n* includes a plurality of nozzles 12 to jet the ink. The nozzles 12 jet the ink to form a color image corresponding to cyan, magenta, yellow and black. Here, the nozzles 12 jetting the same color are disposed in a straight line or in a zigzag line. For example, the nozzles 12 are disposed on nozzle groups 12*a*, 12*b*, 12*c*, and 12*d* as illustrated in FIG. 2. The nozzle groups 12*a*, 12*b*, 12*c*, and 12*d* may correspond to cyan, magenta, yellow, and black. The nozzles 12 in the head chips 10*a*, 10*b*, . . . , and 10*n* may be driven respectively or in predetermined groups by a driving circuit in the printing head.

The storage part 20 stores a jetting time of the head chip 10*a*, 10*b*, . . . , or 10*n* according to a reference jetting gap and a reference jetting speed of each head chip 10 to the print medium. In the present exemplary embodiment, the storage part 20 may be provided as a customer replacement unit monitor (CRUM) or a fuse read only memory (ROM) provided in the printing head.

The jetting time of the head chip 10*a*, 10*b*, . . . , or 10*n* is referred to a jetting timing of the ink, that is, timing between jetting of the ink from at least one of the respective nozzles 12 or respective nozzle groups 12*a*, 12*b*, 12*c*, and 12*d*, and the respective head chips 10*a*, 10*b*, . . . , and 10*n*, with respect to the fed print medium. When a predetermined position of the fed print medium is located to correspond to the at least one of the respective nozzles 12 or respective nozzle groups 12*a*, 12*b*, 12*c*, and 12*d*, and the respective head chips 10*a*, 10*b*, . . . , and 10*n*, the ink is ejected from the respective nozzles 12 according to the print data.

The storage part 20 stores a reference jetting gap and a reference jetting speed of each head chip 10*a*, 10*b*, . . . , or 10*n*. In detail, the storage part 20 may store a lookup table which stores a traveling distance of the print medium during a time elapsed between a time when ink is jetted from the head chips 10*a*, 10*b*, . . . , and 10*n* and a time when the ink is dropped on the print medium according to a measured jetting gap and a jetting speed of each head chip 10*a*, 10*b*, . . . , or 10*n*. Here, the traveling distance of the print medium refers to a drop variation of the ink.

The controller 30 compares the jetting gap between the head chip 10*a*, 10*b*, . . . , or 10*n* and the print medium with the reference jetting gap and determines a jetting time of the head chip 10*a*, 10*b*, . . . , and/or 10*n*. Hereinafter, an operation of the controller 30 according to the present exemplary embodiment will be described with reference to Table 1.

TABLE 1

| | Printing speed (ppm) | | | | | |
|---|---|---|---|---|---|---|
| | 10 | 20 | 30 | 40 | 50 | 60 |
| Length of print medium (mm) | 297 | 297 | 297 | 297 | 297 | 297 |
| Traveling speed of print medium (m/s) | 0.06 | 0.11 | 0.17 | 0.23 | 0.28 | 0.34 |
| Jetting speed (m/s) | 15 | 15 | 15 | 15 | 15 | 15 |

TABLE 1-continued

| | | Printing speed (ppm) | | | | | |
|---|---|---|---|---|---|---|---|
| | | 10 | 20 | 30 | 40 | 50 | 60 |
| Variation according to jetting gap (um) | 0.5 mm | 1.89 | 3.78 | 5.67 | 7.56 | 9.44 | 11.33 |
| | 1.0 mm | 3.78 | 7.56 | 11.33 | 15.11 | 18.89 | 22.67 |
| | 1.5 mm | 5.67 | 11.33 | 17.00 | 22.67 | 28.33 | 34.00 |
| | 2.0 mm | 7.56 | 15.11 | 22.67 | 30.22 | 37.78 | 45.33 |
| | 2.5 mm | 9.44 | 11.89 | 28.33 | 37.78 | 47.22 | 56.67 |
| | 3.0 mm | 11.33 | 22.67 | 34.00 | 45.33 | 56.67 | 68.00 |

Table 1 shows the drop variation of the ink during the time elapsed from the time when ink is jetted from the head chip 10*a*, 10*b*, . . . , or 10*n* until the time when the ink is dropped on the print medium according to the jetting gap and jetting speed of each head chip 10. Here, the jetting speed of each head chip 10*a*, 10*b*, . . . , or 10*n* may be all given 15 m/s regardless of the jetting gap thereof.

As shown in Table 1, the longer the jetting gap of the head chip 10*a*, 10*b*, . . . , or 10*n* is, the larger the drop variation of the ink is. Further, the faster a printing speed is, the larger the drop variation of the ink is.

The controller 30 compares the jetting gap between the head chip 10*a*, 10*b*, . . . , or 10*n* and the print medium with the reference jetting gap stored in the storage part 20. Thus, the controller 30 determines the jetting time of the head chip 10 according to a result of comparison so that the drop variation of the ink to the print medium becomes zero.

For example, when a printing speed is given 30 ppm and a jetting gap of the head chip 10*a* to the print medium is given 1.0 mm, a variation may be 11.33 um. Thus, if a measured variation is 11.99 um, the controller 30 advances a jetting time of the head chip 10*a* as much as time of a difference of 0.66 um divided by the jetting speed of 15 m/s. Repeating the foregoing process for head chips 10*b*, . . . , and 10*n*, the controller 30 may independently and accurately determine the time when each of the head chips 10 jets ink regardless of variations of the head chips 10*a*, 10*b*, . . . , and 10*n* which may be generated in a manufacturing process.

Meanwhile, the controller 30 may determine the jetting time of the head chip 10*a*, 10*b*, . . . , and/or 10*n* before forming an image on the print medium or while forming an image on the print medium.

The controller 30 may determine a jetting time of one of the head chip 10*a*, 10*b*, . . . , and 10*n* based on at least the other one of the head chips 10*a*, 10*b*, . . . , and 10*n*, which will be explained hereinafter with reference to Table 2.

TABLE 2

| | | Printing speed (ppm) | | | | | |
|---|---|---|---|---|---|---|---|
| | | 10 | 20 | 30 | 40 | 50 | 60 |
| Length of print medium (mm) | | 297 | 297 | 297 | 297 | 297 | 297 |
| Traveling speed of print medium (m/s) | | 0.06 | 0.11 | 0.17 | 0.23 | 0.28 | 0.34 |
| Jetting speed (m/s) | | 15 | 15 | 15 | 15 | 15 | 15 |
| Variation according to jetting gap (um) | 0.5 mm | −3.78 | −7.56 | −11.33 | −15.11 | −18.89 | −22.67 |
| | 1.0 mm | −1.89 | −3.78 | −5.67 | −7.56 | −9.44 | −11.33 |
| | 1.5 mm | 0.00 | 0.00 | 0.00 | 0.00 | 0.00 | 0.00 |
| | 2.0 mm | 1.89 | 3.78 | 5.67 | 7.56 | 9.44 | 11.33 |
| | 2.5 mm | 3.78 | 7.56 | 11.33 | 15.11 | 18.89 | 22.67 |
| | 3.0 mm | 5.67 | 11.33 | 17.00 | 22.67 | 28.33 | 34.00 |

Table 2 shows a drop variation of ink based on a jetting gap of 1.5 mm from the time ink is jetted from the head 10*a*, 10*b*, . . . , or 10*n* 10 until the time the ink is dropped on the print medium according to the jetting gap and jetting speed of each head chip 10*a*, 10*b*, . . . , or 10*n*.

Here, when variations are obtained from the jetting gap of 1.5 mm, variations obtained from the other jetting gaps may be symmetric values with respect to the variations of the jetting gap. Thus, if jetting times of the head chips 10*a*, 10*b*, . . . , and 10*n* are determined based on the jetting gap of 1.5 mm, the controller 30 accurately determines the jetting times of the head chips 10*a*, 10*b*, . . . , and 10*n* although the variations are not stored in the storage part 30, by regarding a jetting gap 2.0 mm as 1, a jetting gap 2.5 mm as 2, a jetting gap 1.0 mm as −1 and a jetting gap 0.5 mm as −2.

Meanwhile, the controller 30 may compare the jetting speed of each head chip 10*a*, 10*b*, . . . , or 10*n* with the reference jetting speed and determine a jetting time of the head chip 10*a*, 10*b*, . . . , and/or 10*n*, which will be explained hereinafter with reference to Table 3.

TABLE 3

| | | Printing speed (ppm) | | | | | |
|---|---|---|---|---|---|---|---|
| | | 10 | 20 | 30 | 40 | 50 | 60 |
| Length of print medium (mm) | | 297 | 297 | 297 | 297 | 297 | 297 |
| Traveling speed of print medium (m/s) | | 0.06 | 0.11 | 0.17 | 0.23 | 0.28 | 0.34 |
| Jetting gap (mm) | | 1.5 | 1.5 | 1.5 | 1.5 | 1.5 | 1.5 |
| Variation according to jetting gap (um) | 5 m/s | 17.00 | 34.00 | 51.00 | 68.00 | 85.00 | 102.00 |
| | 10 m/s | 8.50 | 17.00 | 25.50 | 34.00 | 42.50 | 51.00 |
| | 12 m/s | 7.08 | 14.17 | 21.25 | 28.33 | 35.42 | 42.50 |
| | 15 m/s | 5.67 | 11.33 | 17.00 | 22.67 | 28.33 | 34.00 |
| | 18 m/s | 4.72 | 9.44 | 14.17 | 18.89 | 23.61 | 28.33 |
| | 20 m/s | 4.25 | 8.50 | 12.75 | 17.00 | 21.25 | 25.50 |
| | 25 m/s | 3.40 | 6.80 | 10.20 | 13.60 | 17.00 | 20.40 |

Table 3 shows a traveling distance of a print medium during a time elapsed from the time ink is jetted from the head chip 10*a*, 10*b*, . . . , or 10*n* until the time the ink is dropped on the print medium according to a jetting gap of each head chip 10*a*, 10*b*, . . . , and 10*n*.

As shown in Table 3, the faster the jetting speed of the head chip 10*a*, 10*b*, . . . , and/or 10*n* is, the smaller the drop variation of the ink is. Further, the faster a printing speed is, the larger the drop variation of the ink is.

The controller 30 compares the jetting speed of the head chip 10*a*, 10*b*, . . . , and/or 10*n* with the reference jetting speed stored in the storage part 20. Thus, the controller 30 determines the jetting time of the head chip 10*a*, 10*b*, . . . , and/or 10*n* according to a result of comparison so that the drop variation of the ink to the print medium becomes zero.

For example, provided that a printing speed is given 30 ppm and a jetting speed of the head chip 10*a* to the print medium is given 15 m/s, a variation is 17.00 um. Thus, if a measured variation is 17.33 um, the controller 30 advances a jetting time of the head chip 10*a* as much as time of a difference of 0.33 um divided by the jetting speed of 15 m/s. Repeating the foregoing process for head chips 10*b* through 10*n*, the controller 30 may independently and accurately determine the time when each of the head chips 10 jets ink regardless of variations of the head chips 10 which may be generated in a manufacturing process as in determining the jetting time according to the jetting gap.

Here, considering variations according to the other jetting speeds based on variations according to the jetting speed of 15 m/s, as a variation indicates a traveling distance of the print medium and is proportionate to the square of a speed, a variation in a jetting speed of 12 m/s and a variation in a jetting speed of 20 m/s are symmetric values. Thus, if jetting times of the head chips 10*a*, 10*b*, . . . , and 10*n* are determined based on the jetting speed of 15 m/s, the controller 30 accurately determines the jetting times of the head chips 10*a*, 10*b*, . . . , and 10*n* although the variations are not stored in the storage part 30, by regarding a jetting speed of 20 m/s as 1, a jetting speed 30 m/s as 2, a jetting speed 12 m/s as −1 and a jetting speed 9 m/s as −2.

Here, the controller 30 determines the jetting times of the head chips 10*a*, 10*b*, . . . , and 10*n* depending on either the jetting speed or jetting gap thereof, or determines the jetting times more accurately considering both of them.

Referring to FIG. 23, as each of the head chips 10 includes the plurality of nozzles 12, the controller 30 may determine a jetting time of each of the nozzles 12 or each of groups of the nozzles 12. In detail, the controller 30 may determine a jetting time of each of the nozzles 12*a*, 12*b*, 12*c* and 12*c* by colors. In this case, the jetting time may be determined in detail as compared with the case of determining the jetting time by the head chips 10.

TABLE 4

| | | Printing speed (ppm) | | | | | |
|---|---|---|---|---|---|---|---|
| | | 10 | 20 | 30 | 40 | 50 | 60 |
| Length of print medium (mm) | | 297 | 297 | 297 | 297 | 297 | 297 |
| Traveling speed of print medium (m/s) | | 0.06 | 0.11 | 0.17 | 0.23 | 0.28 | 0.34 |
| Jetting gap (mm) | | 1.5 | 1.5 | 1.5 | 1.5 | 1.5 | 1.5 |
| Variation according to jetting gap (um) | 5 m/s | 11.33 | 22.67 | 34.00 | 45.33 | 56.67 | 68.00 |
| | 10 m/s | 2.83 | 5.67 | 8.50 | 11.33 | 14.17 | 17.00 |
| | 12 m/s | 1.42 | 2.83 | 4.25 | 5.67 | 7.08 | 8.50 |
| | 15 m/s | 0.00 | 0.00 | 0.00 | 0.00 | 0.00 | 0.00 |
| | 18 m/s | −0.94 | −1.89 | −2.83 | −3.78 | −4.72 | −5.67 |
| | 20 m/s | −1.42 | −2.83 | −4.25 | −5.67 | −7.08 | −8.50 |
| | 25 m/s | −2.27 | −4.53 | −6.80 | −9.07 | −11.33 | −13.60 |

Table 4 shows a drop variation of ink based on a jetting speed of 15 m/s during a time elapsed from the time ink is jetted from the head chip 10*a*, 10*b*, . . . , and/or 10*n* until the time the ink is dropped on the print medium according to the jetting speed of each head chip 10*a*, 10*b*, . . . , or 10*n*.

The image forming apparatus 1 may also include a measuring unit to measure a jetting gap between the print medium and the head chips 10*a*, 10*b*, 10*c*, 10*d*, . . . 10*n*−1, and 10*n*, and to measure a jetting speed of the ink from nozzles of the head chips 10*a*, 10*b*, 10*c*, 10*d*, . . . 10*n*−1, and 10*n*. The controller 30 receives the measured jetting gap and the jetting speed to be compared with the reference jetting gap and the reference jetting speed, respectively.

Figure 4:
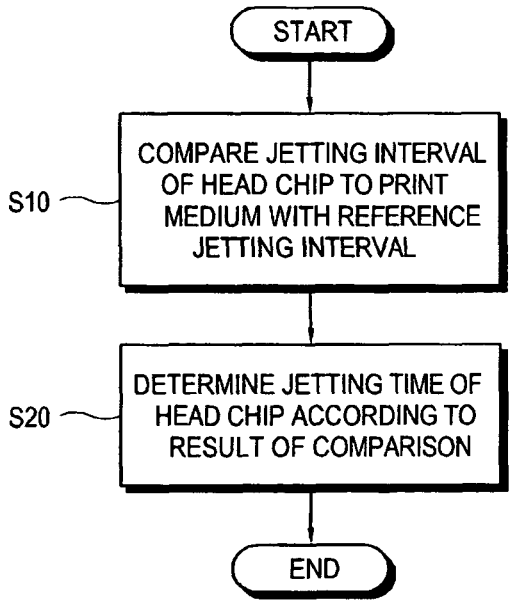
FIG. 4 is a flowchart to illustrate an ink jetting method of an image forming apparatus according to an exemplary embodiment of the present general inventive concept.

Hereinafter, an ink jetting method of the image forming apparatus 1 according to the exemplary embodiment of the present invention will be described with reference to FIG. 4.

First, the controller 30 compares the jetting gaps of the head chips 10*a*, 10*b*, . . . , and 10*n* to the print medium with the reference jetting gap (S10). Here, the controller may further compare the jetting speeds of the head chips 10*a*, 10*b*, . . . , and 10*n* with the reference jetting speed, and the storage part 20 may further store the reference jetting gap and the reference jetting speed.

Subsequently, the controller 30 determines the jetting times of the head chips 10*a*, 10*b*, . . . , and 10*n* according to the result of the comparison. Accordingly, the controller 30 accurately determines a time when each of the head chips 10*a*, 10*b*, . . . , and 10*n* jets ink regardless of variations of the head chips 10*a*, 10*b*, . . . , and 10*n* which may be generated in a manufacturing process.

The controller 30 compares jetting gaps of the nozzles 12 in the head chips 10*a*, 10*b*, . . . , and 10*n* to the print medium and jetting speeds thereof with the reference jetting gap and the reference jetting speed respectively at operation S10. Then, the controller 30 determines the jetting times of the nozzles 12 at operation S20. Here, the controller 30 determines the jetting times of the nozzles 12 in the head chips 10*a*, 10*b*, . . . , and 10*n* respectively or by groups, thereby determining the jetting times more accurately.

The present general inventive concept can also be embodied as computer-readable codes on a computer-readable medium. The computer-readable medium can include a computer-readable recording medium and a computer-readable transmission medium. The computer-readable recording medium is any data storage device that can store data which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As described above, the present general inventive concept provides an image forming apparatus and an ink jetting method thereof which adjust a jetting time of a head chip according to a jetting gap of the head chip to a print medium and a jetting speed of the head chip, thereby maintaining a quality of a print image regardless of a variation of the head chip in a manufacturing process.

Further, the present general inventive concept provides an image forming apparatus and an ink jetting method thereof which determine jetting times of a plurality of nozzles in a head chip respectively or by groups, thereby determining a jetting time of the head chip more accurately.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents

What is claimed is:

1. An image forming apparatus comprising:

a plurality of head chips which comprise a plurality of nozzles to jet ink to a print medium according to print data; and a controller which compares a measured drop variation of a jetting gap of a head chip of the plurality of head chips with a drop variation of a reference jetting gap to determine an adjusted jetting time of the head chip based on a difference between the drop variation of the reference jetting gap and the measured drop variation, while forming an image on the print medium, to correct variations in the head chip, wherein each of the plurality of head chips includes respectively the plurality of nozzles to jet the ink to form a color image corresponding to cyan, magenta, yellow and black.

2. The image forming apparatus according to claim 1, wherein the controller compares drop variations of jetting speeds of the head chips with a drop variation of a reference jetting speed and determines the adjusted jetting times of the head chips.

3. The image forming apparatus according to claim 2, further comprising a storage part, wherein the controller stores the adjusted jetting times according to the reference jetting gap in the storage part.

4. The image forming apparatus according to claim 3, wherein the controller determines the adjusted jetting time of at least one of the head chips, and determines the adjusted jetting time of another one of the head chips according to the determined jetting time of the at least one of the head chips.

5. The image forming apparatus according to claim 3, wherein the controller compares jetting gaps of each of the plurality of nozzles to the print medium with a reference jetting gap and determines the adjusted jetting times of the each of the plurality of nozzles.

6. The image forming apparatus according to claim 3, wherein the stored reference jetting gaps are stored in a table, and wherein the table includes ink drop position variation information based on a reference jetting gap, such that other ink drop position variation information based on different jetting gaps are symmetrical about the reference jetting gap.

7. An image forming apparatus comprising:

a plurality of head chips which comprise a plurality of nozzles to jet ink to a print medium according to print data; and a controller which compares measured drop variations of jetting speeds of a head chip of the plurality of head chips with a drop variation of a reference jetting speed to determine adjusted jetting times of the head chip based on a difference between the drop variation of the reference jetting speed and the measured drop variation of the jetting speed, while forming an image on the print medium, to correct variations in the head chip, wherein each of the plurality of head chips includes respectively the plurality of nozzles to jet the ink to form a color image corresponding to cyan, magenta, yellow and black.

8. The image forming apparatus according to claim 7, further comprising:

a storage part, wherein the controller stores the adjusted jetting times according to the reference jetting speed in the storage part.

9. The image forming apparatus according to claim 8, wherein the controller determines the adjusted jetting time of at least one of the head chips, and determines the adjusted jetting time of another one of the head chips according to the determined jetting time of the at least one of the head chips.

10. The image forming apparatus according to claim 8, wherein the controller compares jetting speeds of each of the plurality of nozzles with a reference jetting speed and determines the jetting times of the each of the plurality of nozzles.

11. The image forming apparatus according to claim 8, wherein the stored reference jetting speeds are stored in a table, and wherein the table includes ink drop position variation information based on a reference jetting speed such that other ink drop position variation information based on different jetting speeds are symmetrical about the reference jetting speed.

12. An ink jetting method of an image forming apparatus which comprises a plurality of head chips including a plurality of nozzles to jet ink to a print medium according to print data, the method comprising:

comparing measured drop variations of jetting gaps of a head chip of the plurality of head chips with a drop variation of a reference jetting gap; and determining an adjusted jetting time of the head chip according to a result of the comparison, while forming an image on the print medium, to correct variations in the head chip, wherein each of the plurality of head chips includes respectively the plurality of nozzles to jet the ink to form a color image corresponding to cyan, magenta, yellow and black.

13. The ink jetting method according to claim 12, wherein the comparing of the jetting gaps further comprises comparing jetting speeds of the head chip with a reference jetting speed.

14. The ink jetting method according to claim 13, further comprising:

storing the reference jetting gap and the reference jetting speed, wherein the jetting gaps of the head chips and the jetting speeds thereof are compared with the reference jetting gap and the reference jetting speed, respectively.

15. An ink jetting method of an image forming apparatus which comprises a plurality of head chips including a plurality of nozzles to jet ink to a print medium according to print data, the method comprising:

comparing measured drop variations of jetting speeds of the plurality of head chips with a drop variation of a reference jetting speed; and determining adjusted jetting times of the head chips according to a result of the comparison, while forming an image on the print medium, to correct variations in the head chips, wherein each of the plurality of head chips includes respectively the plurality of nozzles to jet the ink to form a color image corresponding to cyan, magenta, yellow and black.

16. The ink jetting method according to claim 15, further comprising:

storing a reference jetting gap and the reference jetting speed, wherein jetting gaps of the head chips and the jetting speeds thereof are compared with the reference jetting gap and the reference jetting speed, respectively.

17. The ink jetting method according to claim 16, wherein at least one of the adjusted jetting times is determined to correspond to at least one of the head chips, and the other adjusted jetting times are determined according to the determined at least one adjusted jetting time to correspond to the other head chips.

18. The ink jetting method according to claim 16, wherein the comparing further comprises comparing jetting speeds of the plurality of nozzles with the reference jetting speed, and the determining the adjusted jetting times comprises determining adjusted jetting times of each of the plurality of nozzles.

19. The ink jetting method according to claim 15, wherein at least one adjusted jetting time is determined to correspond to at least one of the head chips, and the other adjusted jetting times are determined according to the determined at least one adjusted jetting time to correspond to the other head chips.

20. The ink jetting method according to claim 15, wherein the comparing further comprises comparing jetting gaps of the plurality of nozzles to the print medium with the reference jetting gap, and the determining the adjusted jetting times comprises determining adjusted jetting times of each of the plurality of nozzles.

21. An image forming apparatus comprising:

a plurality of head chips each having a plurality of nozzles to jet ink to a print medium according to print data; and a controller to generate an adjusted jetting time of a head chip of the plurality of head chips according to a comparison of a drop variation of one or more jetting gaps with a reference drop variation of the one or more jetting gaps and a comparison of drop variations of one or more jetting speeds of the head chip, while forming an image on the print medium, to correct variations in the head chip, wherein each of the plurality of head chips includes respectively the plurality of nozzles to jet the ink to form a color image corresponding to cyan, magenta, yellow and black.

22. A method of an image forming apparatus having a plurality of head chips which comprise a plurality of nozzles to jet ink to a print medium according to print data, the method comprising:

generating adjusted jetting times of a head chip of the plurality of head chips according to a comparison of a drop variation of one or more jetting gaps with a drop variation of a reference jetting gap and a comparison of a drop variation of one or more jetting speeds of the head chip with a drop variation of a reference jetting speed while forming an image on the print medium, to correct variations in a head chip, wherein each of the plurality of head chips includes respectively the plurality of nozzles to jet the ink to form a color image corresponding to cyan, magenta, yellow and black.

23. A controller usable with an image forming apparatus having a plurality of head chips to jet ink onto a print medium, the controller comprising:

a control unit to determine a drop variation of a gap between the plurality of head chips and the print medium, to compare the drop variation of the determined gap with a drop variation of the reference gap having corresponding jetting times, and to control the plurality of head chips to jet the ink based on adjusted jetting times corresponding to the comparison while forming an image on the print medium, to correct variations in a head chip, wherein each of the plurality of head chips includes respectively the plurality of nozzles to jet the ink to form a color image corresponding to cyan, magenta, yellow and black.

24. A controller usable with an image forming apparatus having a plurality of head chips to jet ink onto a print medium, the controller comprising:

a control unit to determine a drop variation of a jetting speed of the plurality of head chips, to compare the determined drop variation of the jetting speed with a drop variation of a reference jetting speed having corresponding jetting times, and to control the plurality of head chips to jet the ink based on adjusted jetting times corresponding to the comparison while forming an image on the print medium, to correct for variations in a head chip, wherein each of the plurality of head chips includes respectively the plurality of nozzles to jet the ink to form a color image corresponding to cyan, magenta, yellow and black.

* * * * *